United States Patent [19]

Bachman et al.

[11] 4,432,153

[45] Feb. 21, 1984

[54] CUP WITH DETACHABLE BOTTOM

[75] Inventors: Gilbert Bachman; Byrne Heninger, both of Atlanta, Ga.

[73] Assignee: Dittler Brothers, Inc., Atlanta, Ga.

[21] Appl. No.: 382,624

[22] Filed: May 27, 1982

[51] Int. Cl.[3] ..... G09F 3/00

[52] U.S. Cl. ..... 40/324

[58] Field of Search ..... 40/306, 324, 312; 229/5.5

[56] References Cited

U.S. PATENT DOCUMENTS

| | | | |
|---|---|---|---|
| 1,004,055 | 9/1911 | Martin et al. | 40/306 |
| 3,110,121 | 11/1963 | Corrinet | 40/306 |
| 3,835,564 | 9/1974 | Gottschalk | 40/306 |
| 3,949,927 | 4/1976 | Smith et al. | 229/5.5 |
| 4,289,265 | 9/1981 | Ellerbrock | 229/5.5 |

FOREIGN PATENT DOCUMENTS

| | | | |
|---|---|---|---|
| 669211 | 11/1929 | France | 40/324 |

*Primary Examiner*—Gene Mancene
*Assistant Examiner*—Wenceslao J. Contreras
*Attorney, Agent, or Firm*—Jones & Askew

[57] ABSTRACT

A contest game piece and a method of manufacturing same. A first portion of a first sheet of material is printed on at least one side with indicia. Perforations are formed through the first sheet of materials defining a boundary partitioning the portion of the first sheet of material printed with the indicia from the other portion of the first sheet of material. A second sheet of material is adhered to the first side of the first sheet of material at portions of the first sheet of material not printed with indicia. The adhered first and second sheets of material are formed into a cup bottom and adhered at its periphery to a side wall of a cup to form a seal therebetween. Apparatus for manufacturing the contest game piece is also disclosed.

5 Claims, 12 Drawing Figures

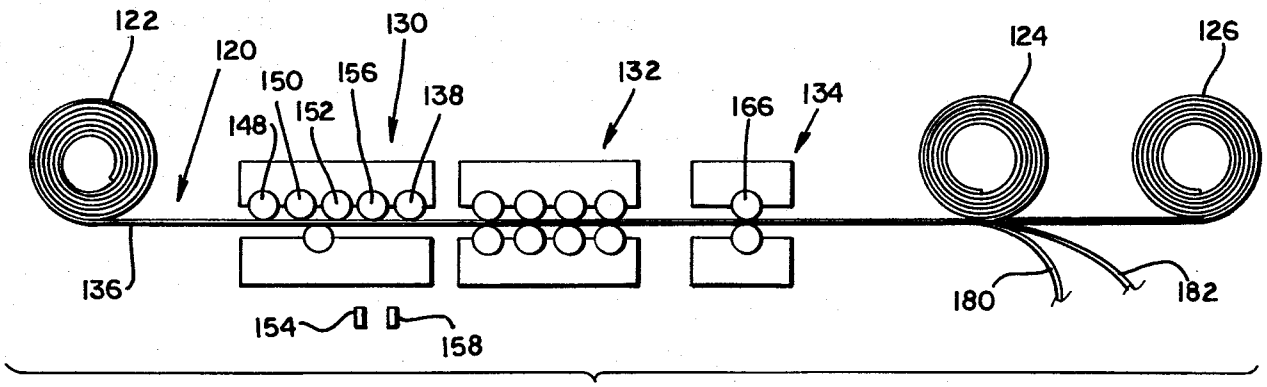
Fig. 7
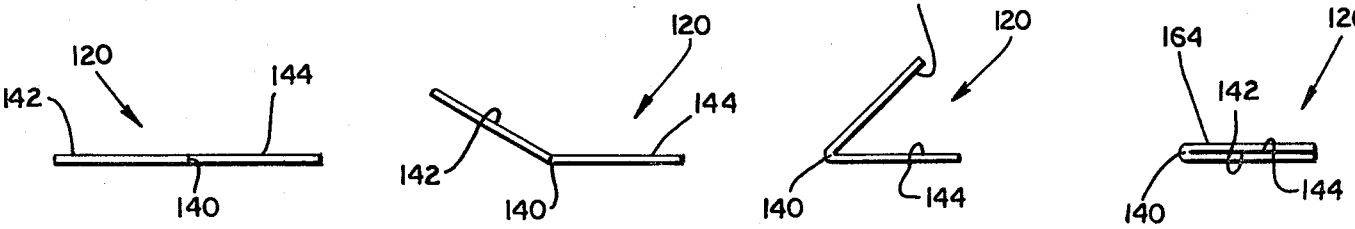
Fig. 9A
Fig. 9B
Fig. 9C
Fig. 9D

CUP WITH DETACHABLE BOTTOM

TECHNICAL FIELD

The present invention relates to beverage cups, and, more specifically, to a cup comprising a removable bottom portion as part of the cup construction which bottom portion can include a contest game piece, a coupon or the like.

BACKGROUND OF THE INVENTION

Throughout the food industry, especially the fast food industry, advertisers and marketing experts have begun to rely heavily on the use of prize coupons or contest games to entice the public to eat in their establishments or to buy their product. One such popular contest is that utilizing game cards or game pieces each of which bears a number, symbol, phrase, or other secret indicia which indicates that the holder is an "Instant Winner" or disclosing a game piece which may be matched with other pieces to warrant a prize. Typically, the game pieces comprise independent game cards or tokens on which are printed and hidden the desired game markings or indicia. The game cards or tokens are usually presented by hand to the customer by a cashier at the business establishment. In such a system, the cashier may incorrectly give to a single customer two, three or more tokens when they should have only given the customer one. Conversely, some customers may not receive a game card to which they are otherwise entitled.

The ultimate object of such games or contests is often to stimulate the patronage of a particular business establishment or the consumption of a particular food item available at the business establishment. Accordingly, it is desirable that the game or contest be as closely associated with the product or object being promoted as possible.

The desirability of promoting various products using gift tokens has been previously recognized, for example in U.S. Pat. No. 3,850,361 (incorporated herein by reference). That patent discloses a disposable cup provided with a gift token formed in the bottom of the cup. Other packaging designs incorporating promotional materials are also known, for example U.S. Pat. Nos. 1,536,716; 2,335,636; 3,214,075 and 3,734,276 (all incorporated herein by reference). Still other packaging designs are disclosed in U.S. Pat. Nos. 1,607,864; 2,433,926; 2,867,365; 3,415,412; 3,456,860; 3,762,628; 3,827,620 and Re. 24,961 (all incorporated herein by reference). However, heretofore an entirely successful game or contest for the promotion of beverages, particularly soft drinks, has not been available.

SUMMARY OF THE INVENTION

The present invention relates to a cup including a removable bottom portion and a method of manufacturing same. A first portion of a first sheet of material is printed on at least one side with indicia. A plurality of cuts are formed through the first sheet of material defining a boundary partitioning the portion of the first sheet of material printed with the indicia from the other portion of the first sheet of material. A second sheet of material is adhered to the first side of the first sheet of material at portions of the first sheet of material not printed with indicia. The adhered first and second sheets of material are formed into cup bottom blanks. The cup bottom blank can be stored for later use or they can individually be adhered at their periphery to a side wall of a cup to form a seal therebetween.

Apparatus for manufacturing the cup including a removable bottom portion comprises first sheet advancing means for moving a first elongate sheet of material along a first path of operation. Positioned along the first path of operation are printing means for selectively printing groupings of indicia on at least a first side of the first sheet of material at intervals to provide a plurality of longitudinally spaced groupings of indicia along the first sheet. Also positioned along the first path of operation are cutting means for forming a plurality of cuts arranged in a predetermined pattern through the first sheet at intervals to provide a plurality of longitudinally spaced patterned cuts along the first sheet. First aligning means associated with the cutting means coordinates the action of the cutting means and the movement of the first sheet along the first path to locate each of the patterned cuts relative to each of the groupings of indicia. Also positioned along the first path of operation are adhesive applicator means for selectively applying adhesive to the first side of the first sheet of material. Second aligning means associated with the adhesive applicator means coordinates the action of the applicator means and the movement of the first sheet along the first path to locate the adhesive relative to each grouping of indicia. Second sheet advancing means are provided for moving a second elongate sheet of material along a second path of operation. Positioned along both the first path of operation and the second path of operation at a point of convergence of the paths are sheet laminating means for contacting the first side of the first sheet of material and one side of the second sheet of material to form a double-layer, laminated product.

Alternately, sheet advancing means advance a sheet of material along a path of operation. Positioned along the path of operation are printing means for selectively printing groupings of indicia on at least a first portion of one side of the sheet of material to provide a plurality of longitudinally spaced groupings of indicia along the first portion. Also positioned along the path of operation are means for selectively applying adhesive on a second portion of the one side of the sheet of material in a predetermined pattern in spaced register with the groupings of indicia. Means for forming a plurality of cuts arranged in a predetermined pattern through the first portion of the sheet of material at intervals to provide a plurality of longitudinally spaced patterned cuts along the first portion are provided along the path of operation. Means for longitudinally folding the sheet of material so that the second portion contacts the first portion and is laminated therewith at selected positions.

Accordingly, it is an object of the present application to provide an improved beverage cup and an improved method and apparatus for its manufacture.

Another object of the present invention is to provide a beverage cup for use in the promotion of beverages, such as soft drinks.

A further object of the present invention is to provide a contest game piece associated with a beverage cup.

Yet another object of the present invention is to provide a beverage cup with a removable section, whereby after removal of the section, the integrity of the cup is relatively unaffected.

Another object of the present invention is to provide a contest game piece which is secured against compromise.

These and other objects, features and advantages of the present invention will become apparent after a review of the following detailed description of the disclosed embodiment and the appended drawing and claims.

BRIEF DESCRIPTION OF THE DRAWING

FIG. 7 is a schematic view of an alternate disclosed embodiment of the cup bottom manufacturing apparatus of the present invention.

FIGS. 9A–9D are schematic side views of the sheet of material shown in FIG. 7 showing the material being folded.

DETAILED DESCRIPTION OF THE DISCLOSED EMBODIMENTS

Figure 2:
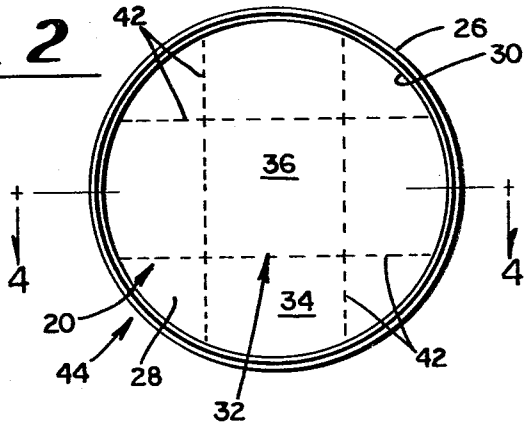
FIG. 2 is a bottom view of the game piece shown in FIG. 1 before the game piece is mounted in the cup side wall.

Referring now to the drawing in which like numbers indicate like elements throughout the several views, it will be seen that there is provided in the illustrated embodiments a cup 10 having a conventional tapered side wall 12 and a bottom portion 14. The bottom portion 14 includes two layers of material 18, 20 joined together by a layer of adhesive 22. The upper layer 18, or the fluid retaining layer, is formed of a solid sheet of material through which water and other fluids will not generally penetrate. Typically, the side wall and the bottom portion are made of a paper stock material which is treated with substances, such as by coating and/or impregnation with a wax-type substance, to enhance the water impervious characteristics of the paper. Such materials are suitable for use in the present invention. The lower layer 20, or game piece layer, is attached to the bottom surface of the upper layer 18 and is accessible from beneath the cup 10. The lower layer is preferably made of a game paper stock as described below.

The upper layer 18 comprises a disk-shaped portion 24 and a first annular flange 26 projecting downwardly from the disk-shaped portion. The lower layer 20 is attached to the upper layer 18 by adhesive 22. The lower layer 20 comprises a disk-shaped portion 28 and a second annular flange 30 protruding downwardly from the disk-shaped portion. The second annular flange 30 is arranged concentric with the first annular flange 26. The lower layer 20 further includes a pattern of perforations 32, preferably in a rectangular pattern (FIG. 2) partitioning the lower layer into a mounting portion 34 and a game piece portion 36. The mounting portion 34 is that portion of the lower layer 20 which is attached to the upper layer 18 by the adhesive 22. The game piece portion 36 is attached to the mounting portion 34 by the sheet material which comprises the lower layer 20, but is defined by and distinguished from the mounting portion by the rectangular pattern of perforations 32. The mounting portion 34 is that portion of the lower layer 20 which is outside the rectangular pattern of perforations 32 and the game piece portion 36 is that portion of the lower layer which is inside the rectangular pattern of perforations. Furthermore, the game piece portion 36 is not attached to the upper layer 18.

Figure 1:
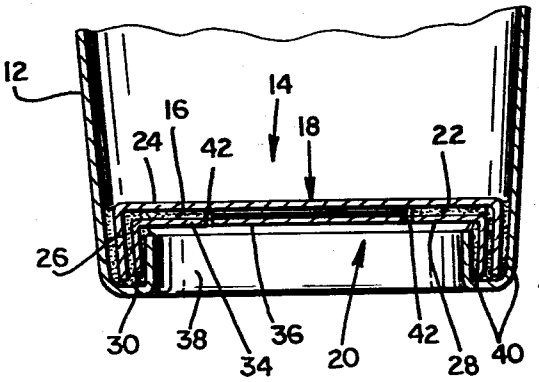
FIG. 1 is a partial cross-sectional side view of a disclosed embodiment of the cup and detachable bottom section of the present invention showing the game piece mounted in the lower portion of the cup.

The bottom portion 14 is mounted in the tapered side wall 12 at the narrower end thereof (bottom end). As seen in FIG. 1, the bottom portion 14 is oriented with the two concentric annular flanges 26, 30 extending downwardly along the inner surface of the side wall 12. The lower most extremity 38 of the side wall 12 is folded upwardly and around the annular flanges 26, 30 forming an upwardly extending annular flange to pinch the flanges of the bottom portion 14 between the side wall 14 and the folded lower extremity of the side wall. Adhesive 48 located between the flanges 26, 30 and the wall 14 and lower extremity 38 binds the cup portions together to form an essentially leak-proof seal.

FIG. 2 shows a bottom view of the bottom portion 14 of the cup 10 before the bottom portion is mounted to the side wall 12. The rectangular pattern of perforations 32 comprises a plurality of perforations 42 cut through the lower layer 20 in a manner well known in the art. The game piece portion 36 is removable from the mounting portion 34 by separating the two portions along the rectangular pattern of perforations 32. It will be appreciated by those skilled in the art that a series of dye cuts can also be made through the lower layer 20 instead of the perforations 42.

Figure 3:
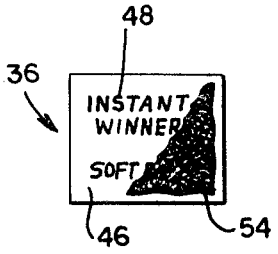
FIG. 3 is a view of the back side of the game piece portion shown in FIG. 1, showing a portion of the removable opaque mask broken away.

As viewed in FIG. 2, the front side 44 of the lower layer 20 is printed with words and symbols. The printing on this front side 44 can extend across both the mounting portion 34 and game piece portion 36 as it is not important that this writing be legible once the game piece portion has been removed. The writing on this front side 44 can include game rules, addresses and other information which the manufacturer desires viewed by the public. FIG. 3 shows the game piece portion 36 after it has been removed from the mounting portion 34. The back side 46 of the game piece portion 36, while attached to the mounting portion 34, faces the upper layer 14 and cannot be viewed by a user of the cup. Once the game piece portion 36 is removed from the mounting portion 34, the user can view the back side 46, and the "secret" contest indicia 48 printed thereon.

Figure 4:
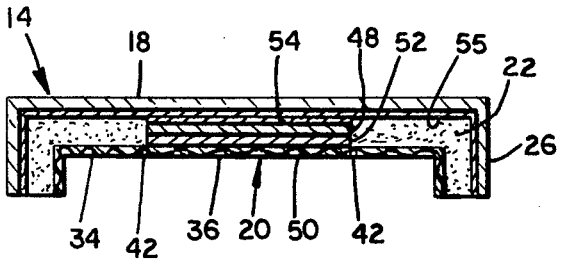
FIG. 4 is a cross-sectional view taken along the line 4—4 of the cup bottom shown in FIG. 2.

The game piece portion 36 is optionally secured against compromise by see through, show through and other compromising techniques through the practicing of techniques described in U.S. Pat. No. 4,241,942 to Bachman (incorporated herein by reference). Accordingly, the lower layer 20 can comprise a sheet of material (or paper stock) which optionally includes a layer of metallic foil 50 either sandwiched into the middle of the paper stock or distributed on the upper and lower surfaces of the paper stock (FIG. 4). Optionally, printed on the back side of the lower layer 20 is a patterned irregular layer of material 52. Printed on the patterned irregular layer 52 is the secret indicia 48. Optionally overlying the secret indicia 48 is a removable, opaque mask 54. An additional patterned irregular layer of material 55 can also be printed on the side of the upper layer 18 adjacent the lower layer 20. The anti-compromise structures of the present invention prevent users from ascertaining the content of the secret indicia 48 prior to the removal of the mask 54 which conceals the secret idicia.

Figure 5:
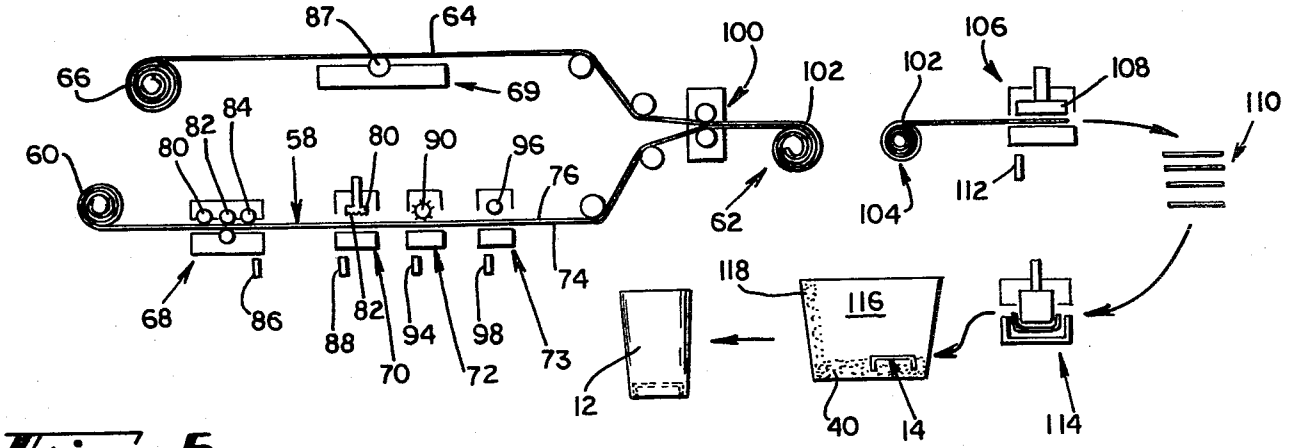
FIG. 5 is a schematic view of a disclosed embodiment of the cup manufacturing apparatus of the present invention.

An apparatus and method for constructing the cup 10 of the present invention is shown schematically in FIG. 5. A first sheet of material 58 feeds from a feed roll 60 along a first path of operation toward a takeup roll 62. The first sheet of material 58 is the paper stock which is used to form the lower layer 20 of the cup 10. A second sheet of material 64 feeds from a feed roll 66 along a second path of operation toward the takeup roll 62. The second sheet of material 64 is the paper stock which is used to form the upper layer 18 of the cup.

Disposed along the first path of operation are a printing device 68, a cross-direction perforating device 70, a machine-direction perforating device 72 and an adhesive applying device 73 through which the first sheet of material feeds. Disposed along the second path of operation is a printing device 69. Printing devices, cross-direction perforating devices, machine-direction perforating devices and adhesive applying devices are all individually well known in the art. At the printing device 68, the first sheet of material 58 is printed on its front side 74 with game rules or other writing which the manufacturer intends to show on the front side 44 of the lower layer 20 of each cup 10. Also, as the first sheet of material passes through the printing device 68, its back side 76 is printed with the secret indicia 48 which the manufacturer desires to appear on the back side 46 of each game piece portion 36 of lower layer 20.

Figure 6:
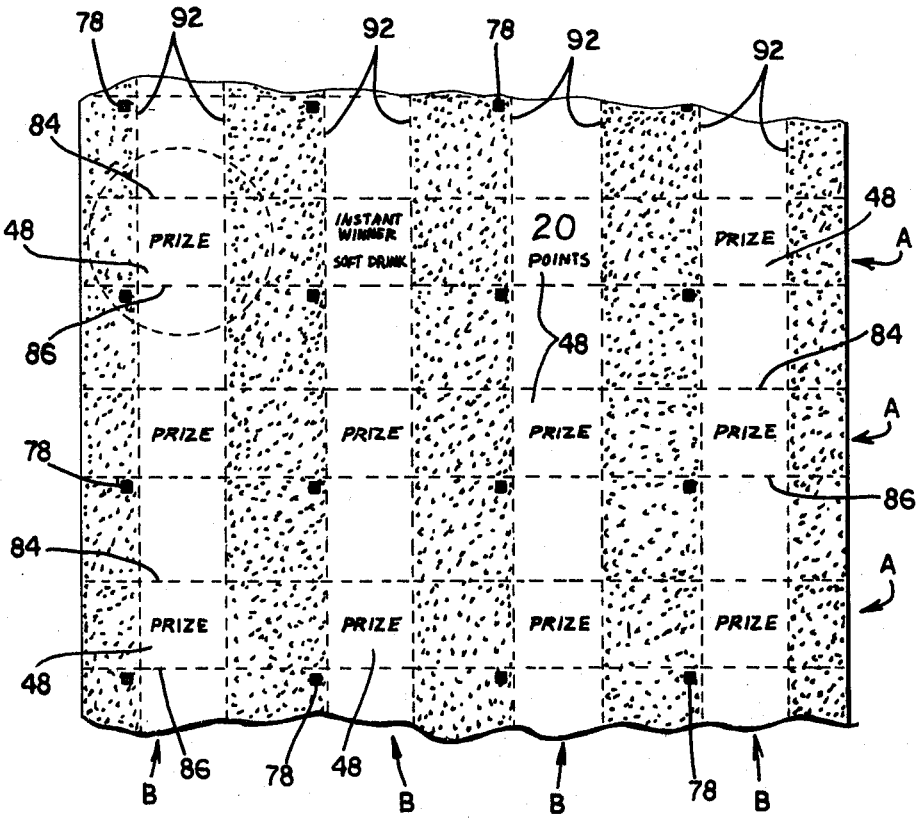
FIG. 6 is a partial top view of a portion of the sheet of game material shown in FIG. 5.

The printing device 68 prints the game rules or other writing on the front side 74 of the first sheet of material 58 repeatedly at longitudinally spaced intervals along the length of the material as the material is moved through the printing device. The printing device 68 also prints the secret indicia 48 on the back side 76 of the first sheet of material 58 repeatedly as groups of indicia at longitudinally spaced intervals along the length of the material as the material moves through the printing device. Preferably, the printing device 68 prints a plurality of rows "A" and column "B" of secret indicia 48 (FIG. 6). Each group of secret indicia 48 can bear indicia identical to the other groups on the first sheet of a material 58 or can bear different indicia as the game requirements or printing device capabilities dictate. Printed on the front side 74 of the first sheet of material 58 and in a predetermined relationship with each group of secret indicia 48 is a cue mark 78 (FIG. 6) which can comprise a dark, black square which is visible to and readable by an electric eye or other similar detection device.

If it is desired that the game piece portions 36 be made secure against see through and/or show through compromising techniques, the back side 76 of the first sheet of material 58 can optionally be printed in the printing device 68 with the patterned irregular layer of material 52 and with the removable opaque mask 54 (FIG. 4). The patterned irregular layer 52 is printed, for example, by roll 80 of the printing device 68 prior to the printing of the secret indicia 48, which indicia is printed, for example, at roll 82. Preferably, the entire back side 76 of the first sheet of material 58 is printed with the patterned irregular layer 52 in order that no particular attention need be paid to the alignment of the printing. The opaque mask 54 is printed after the secret indicia 48 has been printed, as by roll 84. Since it is preferable that the mask 54 be aligned so as to be printed overlying each group of secret indicia 48, an electric eye 86, or other cueing device, is provided to detect the existence of the cue marks 78, and, thus, the presence and location of each group of secret indicia 48. The electric eye 86 operates in cooperation with the printing device 68 to trigger application of the mask 54 when the group of indicia 48 is in proper position for application by the roll 84. Additionally, the underside of the second sheet of material 64 can optionally be printed in the printing device 69 with the patterned irregular layer of material 55. The patterned irregular layer 55 is printed, for example, by roll 87 of the printing device 69. Preferably, the entire underside of the second sheet of material 64 is printed with the patterned layer 55 in order that no particular attention be paid to alignment of the printing.

From the printing device 68, the first sheet of material 58 moves along the first path to the cross-direction dye cutting or perforating device 70. The perforating device 70 is equipped with a stamp 80 including downwardly extending teeth 82 for forming perforations through the material 58. The teeth 82 are arranged on the stamp 80 in a predetermined pattern in order to form a desired predetermined pattern of perforations in the first sheet of material 58. For example, the teeth can be arranged in two parallel rows of spaced apart teeth corresponding to the two rows of cross-direction perforations 84, 86 (FIG. 6). An electric eye 88 accompanies the cross-direction perforating device 70 to detect the cue mark 78 associated with each group of secret indicia 48. The electric eye 88 detects the cue mark 78 and triggers action of the cross-direction perforating device 70 in order that the stamp 80 engage the first sheet of material 58 to perforate the material at the desired location so that the parallel rows of cross direction perforations 84, 86 defined a row "A" of secret indicia 48. The cross-direction perforating device 70, with the aid of the electric eye 88 will stamp the material 58 periodically to border each row "A" of secret indicia 48 with the parallel rows of perforations 84, 86. Alternately, the cross-direction perforating device 70 can be incorporated with the printing device 68, so that the cross perforation function is accomplished simultaneously with printing, or immediately before or thereafter.

From the cross-direction perforating device 70, the first sheet of material 58 moves to the machine-direction perforating device 72. The machine-direction perforating device 72 includes a plurality of rings of teeth 90 spaced laterally across the width of the material 58. The rings 90 rotate with the movement of the first sheet of material 58 to continuously perforate the material along its length, thus, forming a plurality of lines of continuous perforations 92 (FIG. 6). An electric eye 94 detects cue marks 78 and insures that the perforating device 72 and sheet material 58 are in proper alignment. When in proper alignment, the lines of continuous perforations 92 intersect the rows of cross perforations 84, 86 to form the rectangular pattern of perforations 32 surrounding each group of secret indicia 48.

From the machine-direction perforating device 72, the first sheet of material 58 is moved to the adhesive device 73. The adhesive applying device 73 comprises an adhesive applicator roll 96 constructed in such a way as to apply adhesive 22 to portions of the material 58 which lie outside of the patterns of perforation 32 without applying adhesive to those portions of the material which lay inside the patterns of perforation. The adhesive 22 is applied by the roll 96 in strips along the length of the material 58, as seen in FIG. 6, avoiding the game piece portions 36. A fourth electric eye 98 is associated with the adhesive applying device 73 to detect the cue marks 78 and insures that the adhesive applicator 96 and material 58 are in proper alignment.

After leaving the adhesive applying device 73, the paths of the first sheet of material 58 and the second sheet of material 64 converge at a pressing or laminating device 100 where the two sheets are contacted and pressed together. The second sheet of material 64 and first sheet of material are attached through the action of the adhesive 22 to form a unitary, double-layered sheet of cup bottom material 102. The cup bottom material 102 is then collected on the take-up roll 62 in which form it can be stored or transported, if desired. The cup bottom material 102 is then fed from a feed roll 104, or alternately directly from the laminating device 100 if the step of storage is to be avoided, to a cutting device 106. The cutting device 106 comprises a cutter 108, preferably a disk-shaped cutter, which cuts through both layers 58, 64 of the cup bottom material 102 to cut the sheet of cup bottom material into a plurality of disk-shaped segments 110. The segments 110 are cut by the cutting device 106 such that each segment comprises one group of secret indicia 48 surrounded by a pattern of perforations 32 approximately centered in the segment. An electric eye 112 which can detect the cue marks 78 operates in cooperation with the cutting device 106 to center the secret indicia 48 in the segments 110 for cutting.

From the cutting device 16, each disk-shaped segment 110 is moved to a bottom portion-forming device 114. At the forming device 114, the disk-shaped segments 110 are formed into the configuration of the bottom portion 14 (FIGS. 1 and 2) having the disk-shaped plate section 24, 28 and the protruding annular flanges 26,30. The formed bottom portion 14 is then moved from the forming device 114 to engagement with a pre-cut sidewall blank 116. Adhesive 40, 118 is applied to the sidewall blank 116 along the lower edge of the blank and along one of its side edges using suitable adhesive application means (not shown). The bottom portion 14 is placed at the lower edge of the sidewall blank 116 whereupon the blank is wrapped around the bottom portion. The tapered sidewall 12 of the cup 10 is formed as the two sides of the blank 116 are glued together; and the lower most extremity 38 of the sidewall blank is folded up to engage the flanges 26,30 of the bottom portion 14, thus forming the cup 10 seen in FIG. 5 and in greater detail in FIG. 1.

An alternate apparatus and method of constructing the cup 10 of the present invention is shown schematically in FIG. 7. A sheet of material 120 feeds from a feed roll 122 along a path of operation toward three take up rolls 124, 126, 128. The sheet of material is the paper stock which is used to form both the upper layer 18 and the lower layer 20 of the cup 10.

Disposed along the path of operation are a printing device 130, a folding device 132 and a slitting device 134. Printing devices, folding devices and slitting devices are all individually well known in the art. At the printing device 130, the sheet of material 120 is printed on its under surface 136 with the game rules or other writing which the manufacturer intends to show on the front side 44 of the lower layer 20 of each cup 10. Also, as the sheet of material 120 passes through the printing device 130, its upper surface 138 is printed with the secret indicia 48 which the manufacturer desires to appear on the back side 46 of each game piece portion 36 of the lower layer 20.

Figure 8:
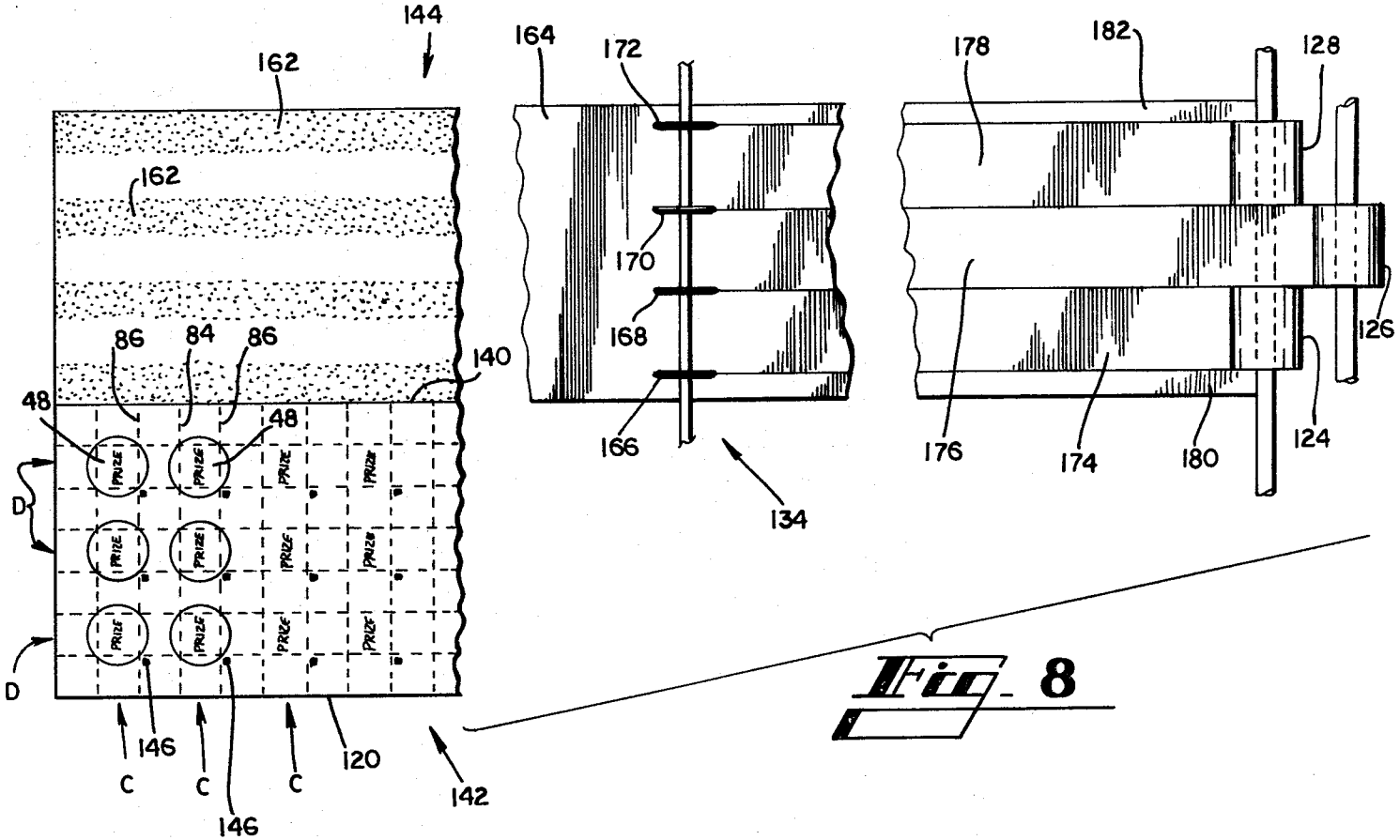
FIG. 8 is a partial top view of a portion of the sheet of material shown in FIG. 7.

The printing device 130 prints the game rules or other writing on the under side 136 of the sheet of material 120 repeatedly at longitudinally spaced intervals along the length of the material as the material is moved through the printing device. An imaginary line 140 longitudinally bisects the width of the sheet of material 120 into a left half 142 and a right half 144 (FIG. 8). The printing device 130 prints the secret indicia 48 on the left half 142 of the upper surface 138 of the sheet of material 120 repeatedly as groups of indicia at longitudinally spaced intervals along the length of the material as the material moves through the printing device. Preferably, the printing device 130 prints a plurality of rows "C" and columns "D" of the secret indicia 48 (FIG. 8). Each group of secret indicia 48 can bear indicia identical to the other groups on the sheet of material 120 or can bear different indicia as the game requirements or printing device capabilities dictate. Printed on the under side 136 of the sheet of material 120 and in a predetermined relationship with each group of secret indicia 48 is a cut mark 146 (FIG. 8) which can comprise a dark, black square which is visible to and readable by an electric eye or other similar detection device.

If it is desired that the game piece portions 36 be made secure against see through and/or show through compromising techniques, the upper surface 138 of the sheet of material can optionally be printed in the printing device with the patterned irregular layer of material 52 and with the removable opaque mask 54 (FIG. 4). The patterned irregular layer 52 is printed, for example, by roll 148 of the printing device 130 prior to the printing of the secret indicia 48, which indicia is printed, for example, at roll 150. Preferably, the entire upper surface 138 of the left half 142 of the sheet of material 120 is printed with the pattern irregular layer 52 in order that no particular attention need be paid to the alignment of the printing. The opaque mask 54 is printed after the secret indicia 48 has been printed, as by roll 152. Since it is preferable that the mask be aligned so as to be printed overlying each group of secret indicia 48, an electric eye 154, or other cueing device, is provided to detect the existence of the cue marks 146, and, thus, the presence and location of each group of secret indicia 48. The electric eye operates in cooperation with the printing device 130 to trigger application of the mask 54 when the group of indicia is in proper position for application by the roll 152. Additionally, the left half 144 of the upper surface 138 of the sheet of material 120 can optionally be printed in the printing device with the patterned irregular layer of material 55. The patterned irregular layer is printed, for example, by the roll 148 so that the patterned irregular layer is printed across the entire width of the upper surface 138 of the sheet of material 120.

Incorporated within the printing device 130 is a roll 156 for perforating a dye cutting the pattern of perforations 32 through the left half 142 of the sheet of material 120. The roll 156 cuts both the rows of cross-direction perforations 84, 86 and the longitudinal lines of continuous perforations 92 (FIG. 8) simultaneously. An electric eye 158, or other cueing device, is provided to detect the cue mark 146 associated with each group of secret indicia 48. The electric eye detects the cue mark 146 and coordinates the action of the roll 156 in order that the rows of cross-direction perforations 84, 86 define a row "C" of secret indicia 48 and the continuous lines of perforations 92 define columns "D" of secret indicia. Furthermore, although the dye cutting roll 156 is shown as cutting the sheet of material 120 after the printing rolls 148–152, it is specifically contemplated that the perforating or dye cutting operation can be carried out prior to printing.

Also incorporated in the printing device 130 is an adhesive applicator roll 160 which is constructed in such a way as to apply adhesive 22 to the right half 144 of the upper surface 138 of the sheet of material 120. The adhesive 22 is applied by the roll 158 in laterally spaced strips 160 along the length of the material 120, as seen in FIG. 8. The strips 162 of adhesive are spaced so that when the sheet of material is folded along the line 140, the strips of adhesive will adhere the left half 142 to the right half 144 at portions outside the pattern of perforations 32 but avoiding the game piece portions 36.

After leaving the printing device 130, the sheet of material 120 is moved to the folding device 132. The folding device 130 takes the flat sheet of material 120 (FIG. 9A) and progressively folds it along the line 140, as shown in FIGS. 9B–9D, so that upper surface 138 of the right half 144 of the sheet of material is pressed into contact and laminated with the right half 142 of the upper surface of the sheet material. The right half 144 and the left half 142 of the sheet of material 120 are therefore attached through the action of the adhesive 22 to form a unitary, double-layered sheet of cup bottom material 164 (FIG. 8). The cup bottom material can then be collected on a take-up roll (not shown) for later use or the material can be moved to the slitting device 134.

The slitting device 134 can include a plurality of laterally spaced circular cutting blades 166, 168, 170, 172. The cutting blades 166–172 are arranged so that a longitudinal cut is made through both layers of the cup bottom material 164 between adjacent columns "D" of secret indicia 48. For example, the blades 166, 168 cut out a first strip 174 of cup bottom material; the blades 168, 170 cut out a second strip 176 of cup bottom material and the blades 170, 172 cut out a third strip 178. Each strip 174–178 of cup bottom material includes a plurality of longitudinally spaced cup bottom blanks each including a single game piece portion 36 bounded by mounting portion 34 of the lower layer 20 which is attached to the upper layer 18 by the adhesive 22. The strips 180, 182 are waste material which can be collected for recycling.

The strips 174–178 of cup bottom material are collected on the take-up rolls 124–128 respectively. As shown in FIG. 8, the take-up rolls 124–128 are alternately longitudinally staggered or offset so that separation of the strips 174–182 is facilitated. That is, the offset take-up rolls aid in pulling the strips 174–182 apart from each other at the points where they have been slit. The individual rolls of cup bottom material can then be stored for later use or they can be processed through the cutting device 106 and bottom portion forming device 114 as described above to form the completed cup (FIG. 5).

Use of the cup 10 will now be considered. A soft drink manufacturer sponsoring a game or contest to promote its product can supply a restaurant, or other beverage dispensing enterprise, with a plurality of cups 10. When a customer orders an appropriate soft drink, the soft drink is received in one of the cups 10 of the present invention. After consuming the soft drink contained in the cup 10, or prior thereto if desired, the customer can grasp the game piece portion 36 of the lower layer 20 and separate it from the mounting portion 34 at the pattern of perforations 32 by pulling the game piece portion from the mounting portion. If desired, a suitable tab can be provided on the game piece portion to facilitate this operation. The secret indicia 48, which heretofore was hidden from view, can then be visually observed. If the contest is of the instant winner-type and if the secret indicia 48 indicate that the customer is a winner, the game piece portion 36 can be redeemed for the appropriate prize. If the game piece portion 36 includes the mask 54 overlying the secret indicia 48, the mask can be removed in the typical manner, such as by scratching with the edge of a coin.

It should be understood, of course, that the foregoing relates only to preferred embodiments of the present invention and that numerous modifications or alterations may be made therein without departing from the spirit and scope of the invention as set forth in the appended claims.

We claim:

1. A nestable and stackable beverage cup for carrying and relinquishing a contest game piece on the bottom thereof, said cup comprising:

a single layered, substantially frustoconically tapered wall portion defining an open top end and an open bottom cavity;

a laminated cup bottom mounted in said open bottom cavity of said wall portion to close said open bottom cavity, said laminated cup bottom including a downwardly disposed annular flange so that said cup bottom will be held spaced apart from the cup bottom of an adjacent one of said cups in a nested stack of said cups, said laminated cup bottom comprising a fluid retaining layer and a game piece layer, said game piece layer comprising a sheet of material having perforations formed therethrough and defining a boundary partitioning said game piece layer into a mounting portion and a game piece portion, indicia printed on at least one side of said game piece portion, and adhesive set between said fluid retaining layer and said mounting portion of said game piece layer, said game piece portion being selectively removable at said boundary of perforations from said laminated cup bottom; and means for joining said wall portion to said cup bottom to provide a seal therebetween.

2. The cup of claim 1, wherein said joining means comprises:

a first annular flange attached to and protruding at approximately right angles from said laminated cup bottom; and a second flange attached and protruding at an acute angle from said wall portion inwardly of said wall portion, said first annular flange being held in sealed relationship between said second flange and said wall portion of said cup.

3. In a nestable and stackable beverage cup comprising a sidewall and a bottom wall mounted in a sealed relationship therewith, the improvement comprising:

a game piece layer mounted to a bottom side of said bottom wall, said game piece layer comprising:

a downwardly disposed annular flange for holding said game piece layer spaced apart from the inside surface of an adjacent one of said cups in a nested stack of said cups, a sheet of material, perforations formed in said sheet of material defining a boundary partitioning said sheet of material into a mounting segment and a game piece segment, indicia printed on at least a first side of said game piece segment, and adhesive selectively disposed between said mounting segment of said game piece layer and said bottom wall of said cup for holding said game piece layer to said bottom wall, whereby said game piece segment is selectively removable from said game piece layer after said game piece layer has been mounted to said bottom wall.

4. The cup of claim 3 further comprising indicia printed on a second side of said game piece segment.

5. The cup of claims 1 or 3, wherein said printed indicia comprises:

a pattern irregular layer of material printed on said first side of said first sheet of material between said first side and said indicia; and an opaque, selectively removable mask overlying said indicia.

* * * * *